US006293648B1

(12) United States Patent
Anderson

(10) Patent No.: US 6,293,648 B1
(45) Date of Patent: Sep. 25, 2001

(54) LIQUID INK PRINTER HAVING A CUSTOMER REPLACEABLE MULTIPLE FUNCTION PRINTHEAD CAPPING ASSEMBLY

(75) Inventor: David G. Anderson, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/122,977

(22) Filed: Jul. 27, 1998

Related U.S. Application Data

(63) Continuation-in-part of application No. 08/563,068, filed on Nov. 27, 1995, now abandoned.

(51) Int. Cl.[7] ..... B41J 2/165
(52) U.S. Cl. ..... 347/29; 347/33; 347/31
(58) Field of Search ..... 347/29, 33, 32, 347/31

(56) References Cited

U.S. PATENT DOCUMENTS 4,073,030 * 2/1978 Albishausen ..... 15/322
5,210,550 * 5/1993 Fisher et al. ..... 347/30
5,574,485 * 11/1996 Anderson et al. ..... 347/27

FOREIGN PATENT DOCUMENTS

401180351 * 7/1989 (JP) ..... 347/29

* cited by examiner

*Primary Examiner*—N. Le
*Assistant Examiner*—Shih-Wen Hsieh
(74) *Attorney, Agent, or Firm*—Tallam I. Nguti

(57) ABSTRACT

An ink jet printer including a movable printhead assembly having printheads including ink and nozzles for printing onto a recording medium, a maintenance assembly having liquid application members for cleaning and priming the printheads, and a customer replaceable, multiple function capping assembly for assuring effective cleaning and continued quality operation of the printheads. For a first function, the capping assembly has a housing defining a fluid chamber containing cleaning liquid, a liquid flow aperture formed through the housing from the fluid chamber, and a snap-in, snap-out valve connector mounted over the liquid flow aperture for supplying cleaning liquid to the maintenance assembly, and for enabling economical, easy customer removal and replacement of the capping assembly within the ink jet printer. For another function, the capping assembly has a fluid release aperture formed through the housing from the fluid chamber, and gasket members mounted around the fluid release aperture for capping, sealing and humidifying the printheads when in a capped position on the capping assembly. The ink jet printer then has a liquid conduit member connected to snap-in, snap-out valve connector of the capping assembly and to the maintenance assembly supply cleaning liquid from the fluid chamber to the maintenance assembly, thus assuring effective cleaning and continued quality operation of the printheads.

11 Claims, 5 Drawing Sheets

LIQUID INK PRINTER HAVING A CUSTOMER REPLACEABLE MULTIPLE FUNCTION PRINTHEAD CAPPING ASSEMBLY

RELATED APPLICATIONS

This is a Continuation-In-Part of U.S. application Ser. No. 08/563,068 filed Nov. 27, 1995 now abandoned and entitled "LIQUID INK PRINTER WITH MAINTENANCE CONSUMABLE".

FIELD OF THE INVENTION

The present invention relates generally to liquid ink printers, and more particularly to such a printer having an economical and quality assuring customer replaceable, multiple function printhead capping assembly.

BACKGROUND OF THE INVENTION

An ink jet printer of the type frequently referred to as drop-on-demand, has at least one printhead from which droplets of ink are directed towards a recording medium. Within the printhead, the ink is contained in a plurality of channels. Piezoelectric devices or power pulses cause the droplets of ink to be expelled as required, from orifices or nozzles located at the end of the channels. In thermal ink jet printing, the power pulses are usually produced by resistors also known as heaters, each located in a respective one of the channels. The heaters are individually addressable to heat and vaporize the ink in the channels. As a voltage is applied across a selected heater, a vapor bubble grows in that particular channel and ink bulges from the channel nozzle. At that stage, the bubble begins to collapse. The ink within the channel retracts and then separates from the bulging ink thereby forming a droplet moving in a direction away from the channel nozzle and towards the recording medium whereupon hitting the recording medium a spot is formed. The channel is then refilled by capillary action which, in turn, draws ink from a supply container of liquid ink.

The ink jet printhead may be incorporated into either a carriage type printer or a page width type printer. The carriage type printer typically has a relatively small printhead containing the ink channels and nozzles. The printhead is usually sealingly attached to a disposable ink supply cartridge and the combined printhead and cartridge assembly is attached to a carriage which is reciprocated to print one swath of information (equal to the length of a column of nozzles) at a time on a stationary recording medium, such as paper or a transparency. After the swath is printed, the paper is stepped a distance equal to the height of the printed swath or a portion thereof so that the next printed swath is overlapping or contiguous therewith. The procedure is repeated until the entire page is printed. In contrast, the pagewidth printer includes a stationary printhead, also known as a printhead assembly, having a length sufficient to print across either the entire width or length of the recording medium. The recording medium is continually moved passed the pagewidth printhead in a direction normal to the length of the printhead and at a constant or varying speed during the printing process.

It has been recognized that there is a need to maintain the ink ejecting nozzles of an ink jet printhead, for example, by periodically cleaning the orifices when the printhead is in use, and/or by capping the printhead when the printer is out of use or is idle for extended periods of time. The capping of the printhead is intended to prevent the ink in the printhead from drying out. There is also a need to prime a printhead before use, to insure that the printhead channels are completely filled with ink and contain no contaminants or air bubbles and also periodically to maintain proper functioning of the orifices.

It has been found that to properly maintain an ink jet printhead two separate operations must be performed, using usually two separate, technician serviceable devices, namely, a maintenance assembly, and a capping assembly. In a first operation, the maintenance assembly is typically used to maintain proper condition or operation of the printhead nozzles by priming the nozzles such as by vacuum, and wipe cleaning clean the face of the printhead to remove any contaminants or ink which may have collected thereon. The second and separate operation is capping the printhead during periods when the printhead nozzles will be exposed to air for extended periods, thereby preventing the ink contained in the nozzles from drying out.

Conventionally, maintenance assemblies and capping assemblies are serviced (including replacement), not by the machine operator, but by a technician. Where a fluid is needed by each of these assemblies, such fluids are usually not common, and are supplied separately, thus involving several costly parts and components. Long printing periods (during which a capping assembly is exposed and idle), can result in warping of the capping assembly seals, as well as in poor printhead capping, thus requiring replacement of the capping assembly.

There is therefore a need for an ink jet printer in which the design and operation of the maintenance assembly and the capping assembly have a number of parts in common thus reducing their costs, and in which the capping assembly is economically and easily replaceable by an operator, thus assuring continued quality operation of the printhead.

SUMMARY OF THE INVENTION

In accordance with one aspect of the present invention, there is provided a customer replaceable, multiple function printhead capping assembly for use in an ink printer. The capping assembly includes a housing having walls including side walls, a bottom wall and a top wall. The walls define a fluid chamber for containing fluid consisting of cleaning liquid and vapors from such liquid. The capping assembly also includes a venting first aperture formed through the top wall of the housing into the chamber for releasing fluid from the chamber, and a substantially airtight sealing member surrounding the venting first aperture for sealing and humidifying an ink jet printhead in a capping position on the capping assembly. The capping assembly further includes a liquid flow second aperture formed through the bottom wall of the housing communicating with the fluid chamber, and a quick snap-in, snap out, valve connector mounted over the liquid flow second aperture for connecting to a maintenance assembly supply line to supply cleaning liquid from the fluid chamber, and for enabling economical easy customer replacement of the capping assembly in order to assure continued quality operation of the printhead.

Pursuant to another aspect of the present invention, there is provided an ink jet printer including a movable printhead assembly having printheads including ink and nozzles for printing onto a recording medium, a maintenance assembly having liquid application members for cleaning and priming the printheads, and a customer replaceable, multiple function capping assembly. For a first function, the capping assembly has a housing defining a fluid chamber containing cleaning liquid, a liquid flow aperture formed through the housing from the fluid chamber, and a snap-in, snap-out valve connector mounted over the liquid flow aperture for supplying cleaning liquid to the maintenance assembly, and for enabling economical, easy customer removal and replacement of the capping assembly within the ink jet printer. For another function, the capping assembly has a fluid release aperture formed through the housing from the fluid chamber, and gasket members mounted around the fluid release aperture for capping, sealing and humidifying the printheads when in a capped position on the capping assembly. The ink jet printer then has a liquid conduit member connected to snap-in, snap-out valve connector of the capping assembly and to the maintenance assembly supply cleaning liquid from the fluid chamber to the maintenance assembly, thus assuring effective cleaning and continued quality operation of the printheads.

Other features of the present invention will become apparent as the following description proceeds and upon reference to the drawings, in which:

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
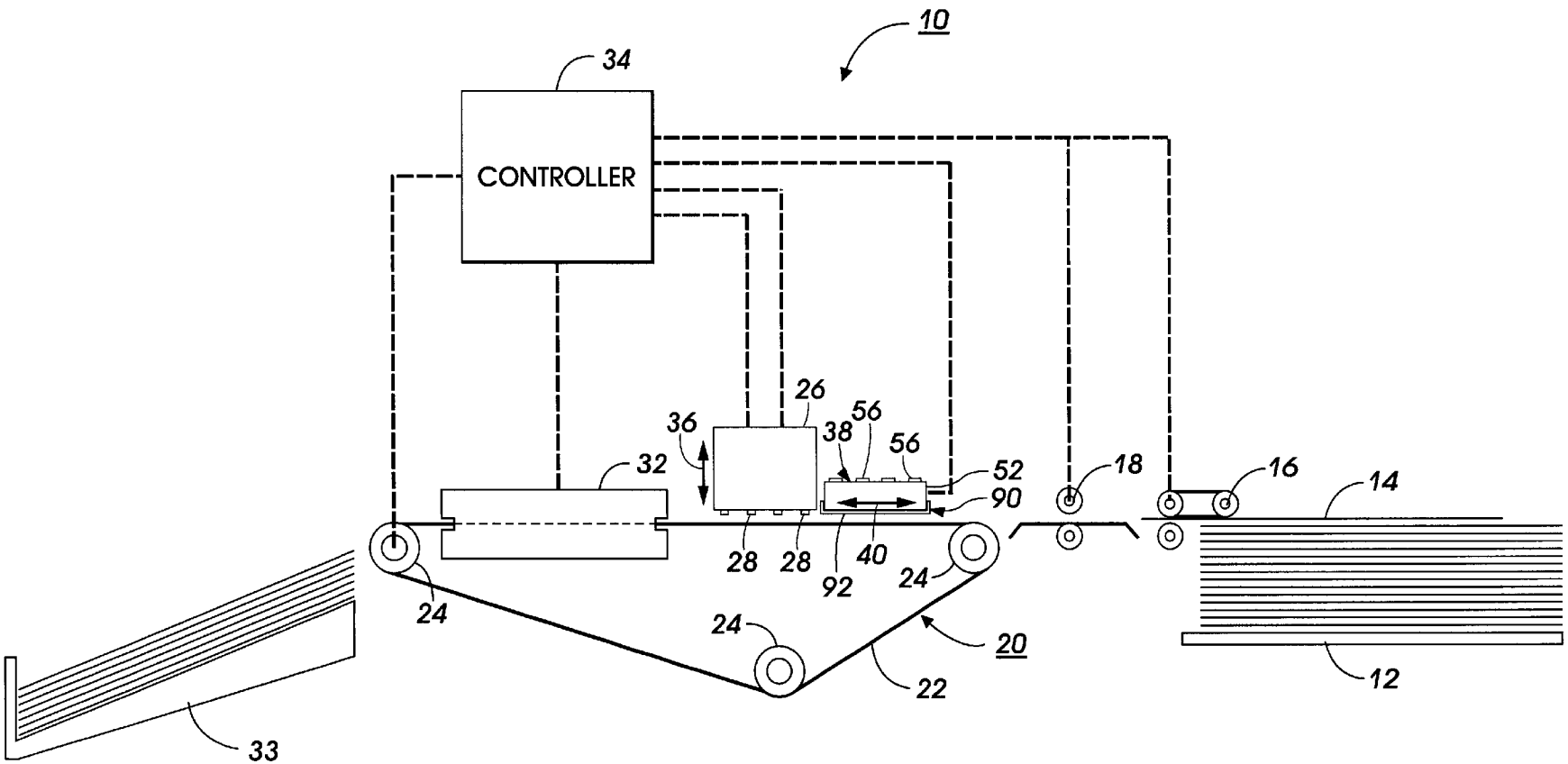
FIG. 1 is a schematic elevational view of an ink jet printer incorporating the customer replaceable, multiple function printhead capping assembly of the present invention.

FIG. 1 illustrates a schematic elevational view of a liquid ink printer 10, for instance, an ink jet printer, of the present invention. The liquid ink printer 10 includes an input tray 12 containing sheets of a recording medium 14 to be printed upon by the printer 10. Single sheets of the recording medium 14 are removed from the input tray 12 by a pickup roller 16 and fed by feed rollers 18 to a transport mechanism 20. The transport mechanism 20 moves the sheet by a feed belt or belts 22 driven by rollers 24 beneath a liquid ink printhead assembly 26. The printhead assembly 26 includes one or more pagewidth printheads 28 supported in a printing position by a printhead support (not shown) in a confronting relation with the belt 22. During printing, the pagewidth printheads 28 deposit liquid ink on the recording medium 14 as it is carried by the belt 22 beneath the plurality of printheads 28. Each of the pagewidth printheads 28 includes an array of print nozzles, for instance, staggered or linear arrays, having a length sufficient to deposit ink in a print zone across the width of the recording medium 14. The present invention is equally applicable, however, to printers having partial width array ink jet printheads. The printhead assembly 26 also includes an ink supply either attached to the printhead support or coupled to the pagewidth printheads through appropriate supply tubing.

The recording medium 14 is then carried by the belt 22 through a dryer 32 for drying the liquid ink thereon. The dryer 32 can be a microwave dryer or other known types of dryers generating sufficient heat energy to dry the liquid ink which has been deposited upon the recording medium 14. If, however, the dryer 32 is a microwave dryer, the belt 22 is preferably made of a material substantially transparent to microwave power and having a relatively low dielectric constant. After the sheet is substantially dry, the sheet is deposited in an output tray 33.

A controller 34 controls the operation of the transport mechanism 20, which includes the pickup roller 16, the feed roller 18 and the drive rollers 24. In addition, the controller 34 controls the movement of the printhead assembly 26, printing by the printheads 28, and operation of the dryer 32, as would be understood by one skilled in the art. The controller 34 can also include a plurality of individual controllers, such as microprocessors or other known devices each dedicated to performing a particular function.

At the completion of a printing operation or when otherwise necessary, such as during a power failure, the printhead assembly 26, which is movable in the directions of an arrow 36, is moved away from the belt 22 such that the capping assembly 38 of the present invention, which itself is movable in the directions of the arrow 40, as a first function, is moved beneath the printhead assembly 26 for capping and humidifying the printheads 28 thereof. Once the capping assembly 38 is positioned directly beneath the printhead assembly 26, the printhead assembly 26 is moved towards the belt 22 and into contact with a plurality of gasket members 56 located on the capping assembly 38.

Figure 2:
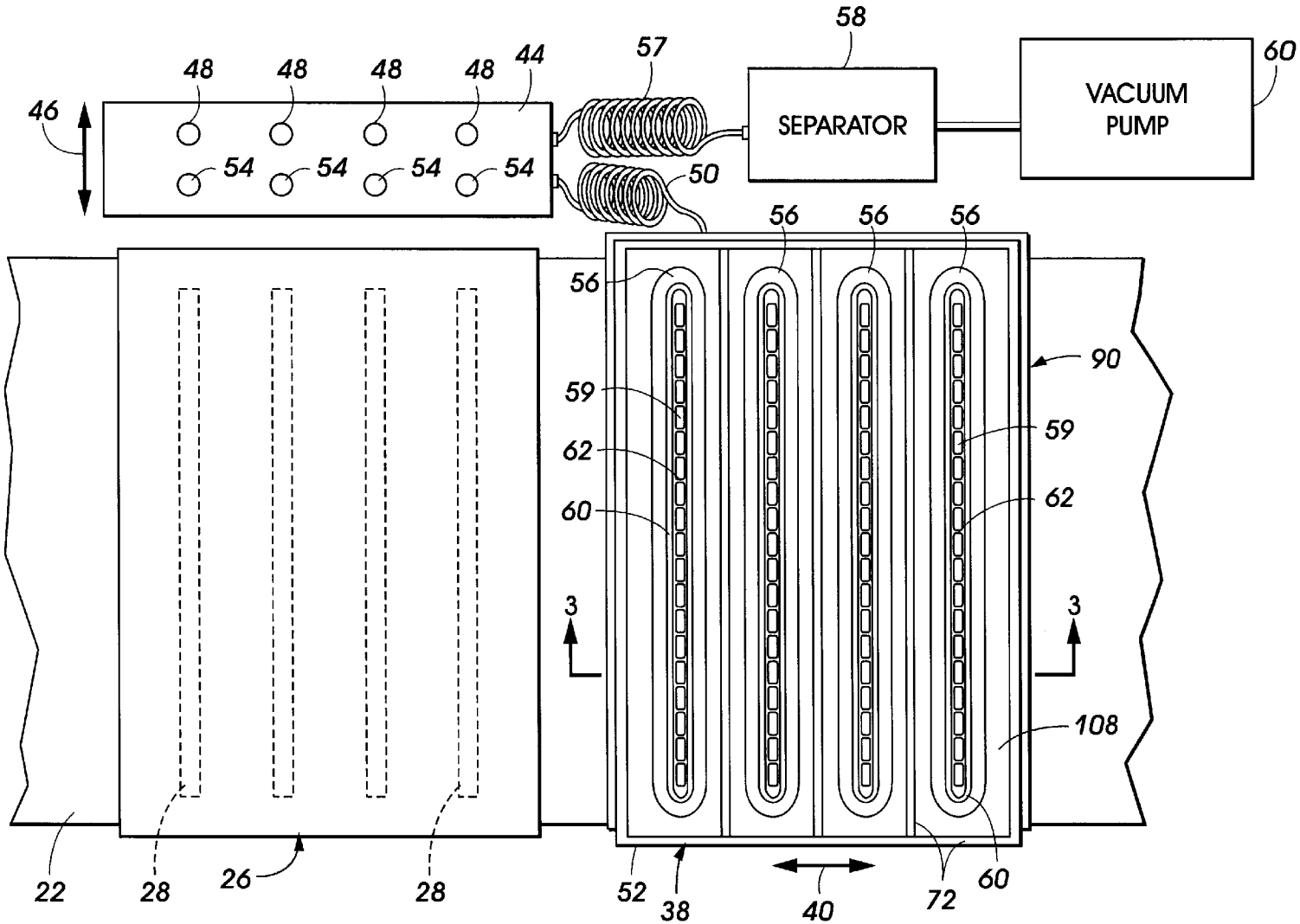
FIG. 2 is schematic plan view of the capping assembly and a maintenance assembly in an ink jet printer in accordance with the present invention.
Figure 3:
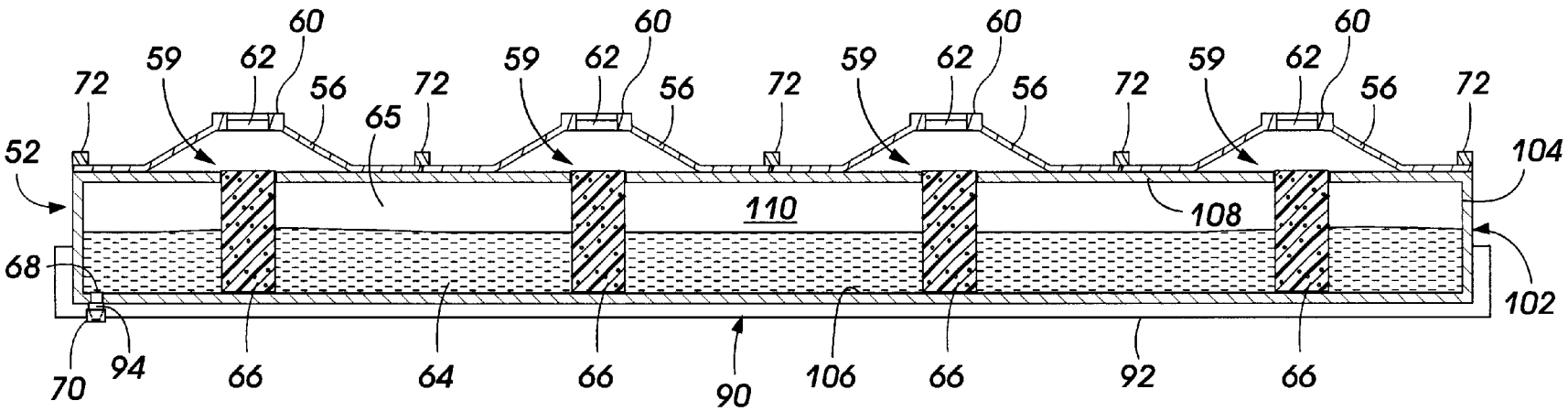
FIG. 3 is a schematic sectional view of the capping assembly as viewed along a line 3—3 of FIG. 2.

Referring in particular to FIGS. 1–3, besides the customer replaceable, multiple function printhead capping assembly 38, the ink jet printer 10 includes a maintenance assembly 44 (not shown in FIG. 1) but illustrated in FIG. 2, (to be described in detail below).

Still referring to FIGS. 1–3, the customer replaceable, multiple function printhead capping assembly 38 of the present includes a housing 100 having walls 102 including side walls 104, a bottom wall 106 and a top wall 108. Together, the walls 102 define a fluid chamber 110 for containing cleaning liquid 64 and vapors 65 from such liquid 64. The capping assembly 38 also includes a fluid releasing or venting first aperture 59 formed through the top wall 108 of the housing into the chamber 110 for releasing liquid 64 and vapors 65 from the chamber. The capping assembly 38 as shown also includes substantially airtight seals or gasket members 56 surrounding the first aperture 59 for sealing and humidifying ink jet printheads 28 in a capping position on the capping assembly 38. The capping assembly 38 further includes a liquid flow second aperture 68, that is formed through the bottom wall 106 of the housing to communicate with the fluid chamber 110.

Importantly, in accordance with the present invention, the capping assembly 38 further includes a quick snap-in, -out, valve connector shown as 94, mounted over the liquid flow second aperture 68. The quick snap-in, snap-out, valve connector 94 as mounted, advantageously enables connecting the fluid chamber 110 to a flexible supply line 50 of the maintenance assembly 44 for supplying cleaning liquid 64 from the fluid chamber 110, as well for as easy and economical customer replacement of the capping assembly. As further shown, a capping assembly support 90 is provided and includes a base 92 for supporting the capping assembly, and for assisting a customer in guiding the capping assembly 38 into a snapped-in position of the valve connector 94. The capping assembly support also provides the necessary attachments member for the supply line 50 and its connector for mating with the valve connector 94 of the capping assembly 38.

In operation, the gaskets or gasket members 56 of the capping assembly 38 engage or contact the page width printheads 28 on an area surrounding one or more of the printheads in order to seal the nozzles of each printhead from exposure to air. Suitable gasket members include those described later herein, or those which compress to make a satisfactory seal. This substantially airtight seal prevents the ink contained in the nozzles from drying out to thereby prevent clogging of the individual printhead assembly nozzles.

Referring again to FIGS. 1 and 2, once a capping operation is complete, the printhead assembly 26 moves away from the belt 22, and the capping assembly 38 moves away from the printhead assembly 26, such that the printhead assembly 26 can be repositioned appropriately with respect to the belt 22 for printing on a recording sheet 14.

FIG. 2 illustrates a plan view of the ink jet printer 10 showing the belt 22, the printhead assembly 26, the capping assembly 38, and the maintenance assembly 44. As previously described, the capping assembly 38 moves in the directions of arrow 40 to cap the individual printheads 28. In addition to the capping assembly 38, however, the maintenance assembly 44 moves in the directions of an arrow 46 for maintaining the nozzles of the printheads 28 when the printhead assembly 26 is sufficiently distanced from the belt 22 to enable the maintenance assembly 44 to move between the belt 22 and the printhead assembly 26.

The maintenance assembly 44 provides two functions, that of (1) wipe cleaning the front face of the ink jet printheads and (2) vacuuming the front face of the ink jet printheads to remove any debris or ink which has coagulated inside the individual nozzles. The maintenance assembly 44 includes a plurality of wet wiper nozzles 48 which receive a supply of maintenance fluid, such as water, over a fluid line 50 coupled to the capping assembly 38. The capping assembly 38 stores the maintenance fluid 64 in a housing 52 which can be made of any number of materials, but typically is made from a moldable plastic. The interior of the housing 52 defines a fluid cavity or chamber for holding the maintenance fluid. The maintenance fluid travels through the maintenance line or liquid conduit member 50 to supply an amount of the maintenance fluid or cleaning liquid to each of the individual wet wipe cleaning nozzles 48. The purpose of the wet wipe cleaning nozzles 48 is to apply maintenance fluid to the front face of the printheads 28 and to reprime (i.e., replenish the liquid ink supply) within the channels of the printheads.

The maintenance assembly 44 also includes a plurality of vacuum nozzles 54, each of which is coupled to a vacuum line 57 connected to a separator 58 which is, in turn, coupled to a vacuum pump 60. The vacuum pump 60 supplies a predetermined amount of vacuum through the separator 58 so that the vacuum nozzles 54 can apply vacuum to the front face of the printhead assembly and, in particular, to the ejecting orifices thereof.

In one method of operation, the maintenance assembly 44 is first moved across the individual printheads 28 so that the vacuum nozzles 54 apply a vacuum to the ink ejecting orifices or nozzles of the printheads in succession. This step removes larger particles such as lint and paper fibers from the front face of the printhead. Preferably, the vacuum through the vacuum nozzles 54 is more than one order of magnitude greater than the typical negative pressure experienced by ink in a channel while a particular ejector is not being used. The preferred range for the vacuum at the vacuum nozzle is about 4 to 10 pounds per square inch (psi) at the nozzle tip. The typical back-pressure for retaining ink within a channel of the printheads 28 is between about a negative 0.03 and negative 0.15 (psi). In this initial vacuuming step, it is acceptable that the vacuum nozzles remove 10 to 20 channel-length volumes of ink or about 0.002 to 0.004 microliters of material from each channel to claim the channel. In this way, every ejector in the full width printhead will be thoroughly cleaned of this plugs.

After the maintenance assembly has moved across the front face of the printheads 28, the direction of the maintenance assembly is reversed such that the wet wiper nozzles or members 48 precede the vacuum nozzles 54 in the direction of travel. As the wet wiper nozzles 48 move across the front face of the printheads 28, they apply a small quantity of maintenance or cleaning liquid received from the housing 52 of the capping assembly 38, to the front face of the individual printheads. According to a preferred embodiment of ink jet printheads, the front face includes a hydrophobic surface, preferably fluorinated carbon DLC ("diamond-like" coating), which causes the applied fluid to bead on the front face.

The wet wiper nozzles 48 include enough outward pressure to cause a small quantity of water to bridge from the wet wiper nozzles to the front face of the printhead without causing undue "weeping" of excess water. A preferred range for outward water pressure from the wet wiper nozzles 48 for meniscus wipe cleaning is between about 0.015 and 0.075 psi. The maintenance fluid applied by the maintenance assembly 44 restores a necessary amount of relative humidity to the area around the ink ejecting orifices. This relative humidity is helpful in, for example, decreasing the likelihood of plugs of dry ink forming too quickly within the ink ejecting orifices. Further, the maintenance fluid may have diluted therein a relatively small amount of detergent, which may be useful in removing certain kinds of dirt and/or other debris from the front face of the printheads. Following the application of the maintenance fluid, the printhead is almost immediately vacuumed again by the vacuum nozzles 54 which follow the wet wiper nozzles 48. This step is helpful in restoring the priming of available liquid ink within the channels immediately before printing resumes.

Ink and other contaminants collected through the vacuum nozzles 48 are separated from the applied airflow by the separator 58 as is known by those skilled in the art.

Once a print job is completed, the capping assembly 38 moves into position to cap and humidify the individual printheads 28 as previously described. As further shown, the capping assembly 38 includes a plurality of gasket members 56, each of which is securely attached to the housing 52. The gasket members are aligned on the housing 52 such that a plurality of venting, first apertures 59 formed in the top wall of the housing 52 are substantially aligned with each of the gasket members 56. The orifices or venting first apertures 59 allow for the venting or transfer of moisture or vapors which evaporate from the maintenance or cleaning liquid contained in the housing 52. Thus each of the apertures 59 in combination with the surrounding capping gasket members 56, creates a humidity chamber for humidifying the linear array of ink ejecting nozzles on the front face of the printheads 28.

When the capping assembly 38 is positioned for capping, the printhead assembly 26 is moved into contact with the gasket members 56 to slightly compress each one of them in order to form a substantially airtight seal. As shown, each of the gasket members 56 include a contacting ridge 60 which contacts the front face of the printheads. Recessed beneath the surface of the contacting ridge 60 is a plurality of individual ribs 62 which provide structure and support for the side walls of the gasket members 56. The ribs 62 prevent the aperture 59 from being closed off so that the ink ejecting nozzles can remain properly humidified during a capping operation.

FIG. 3 illustrates a sectional schematic sideview of the capping assembly along a line 3—3 of FIG. 2. As previously described, the capping assembly 38 is removable and replaceable by an operator guided by a capping assembly support 90. The capping assembly as already described includes a plurality of gasket members 56 mounted thereto and a plurality of venting first apertures 59 for releasing vapors and creating a humidity for properly humidifying the ink ejecting nozzles of the printheads when the capping assembly 38 is in contact with the individual printheads 28. The housing 52 contains a maintenance fluid or liquid 64 which can be water containing a biocide to prevent mold, fungus and/or other organisms from forming.

A plurality of wicks 66 are inserted into each of the venting apertures 59 and have a length sufficient to immerse a portion thereof within the maintenance liquid 64. The wick can be made of any number of materials which absorb a fluid and which transport the fluid to the apertures 59 by capillary action. The fluid is transferred or wicked to the apertures 59 such that the space defined between the gaskets 56 and the housing 52 is properly humidified. Other materials are also possible and include sintered polypropylene available under the trade name Porex available from Porex of Fairbourne, Georgia, and other wicking felts such as urethane foams. It is also possible to properly humidify the ink jet nozzles without the use of a wick, but instead by placing a semi-permeable membrane, such as Goretex™ over the apertures to allow for the transfer of moisture vapor through the membrane but to substantially prevent any leakage of water through the membranes during shipping The gasket members 56 are preferably molded elastomeric gaskets which seal the cap housing against the front face of the printheads 28. The gaskets, however, can be made from flexible or resilient materials providing a good seal under compression such as EPDM rubber or thermoplastic elastomers such as SARLINK® manufactured by DSM Thermoplastic Elastomers Inc. of Leominster, Mass. This deflection allows for system tolerances to be built within the system and assures a good capping seal while minimizing the capping loads and any compression set of the gasket material.

The housing 52 also includes the fluid transfer or liquid flow, second aperture 68 that has the quick snap-in, snap-out valve connector 94 mounted over it for mating with an interconnect 70 of the flexible tubing or line 50, as illustrated in FIG. 2. In this way, the capping assembly 38 serves its second function of supplying maintenance liquid to the wet wiper nozzles 48 for meniscus wipe cleaning of the ink jet printhead nozzles. By incorporating the maintenance liquid into a single capping assembly, the maintenance liquid is eventually used up and must be replaced by either one or more methods. In one proposed alternative solution, the cap housing would have a fill hole (not shown) in which maintenance liquid could be added when necessary.

The present invention, however, contemplates that the capping assembly is a customer replaceable unit which is completely replaced by the customer when the maintenance liquid has been completely used or when any one of the gasket members 56 fail to make a proper seal with the printheads. The capping gasket would fit within a tray or other support within the printer for easy removal and insertion. Since the capping assembly is replaced as a unit, and includes the maintenance liquid within the housing, a water tight shipping seal is necessary to insure that no water leaks or flows from the housing out through the individual venting apertures 59. While the gasket members 56 are mounted to provide an airtight seal in the machine, providing a solid surface against which to seal the gasket members in a shipping package would be expensive, and would represent a leakage risk when the package is exposed to any shipping abuse. Consequently, the customer replaceable unit includes a plurality of raised portions 72 as illustrated in FIG. 3 and also in FIG. 2 which provide a surface upon which a heat sealed membrane can be affixed for shipping.

Figure 4:
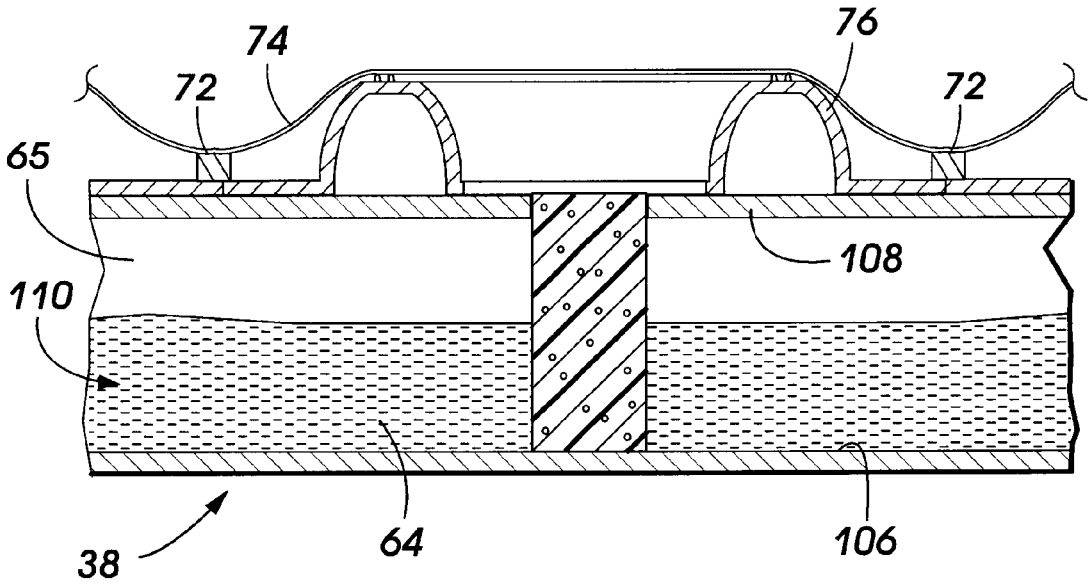
FIG. 4 is a partial sectional side view of a second embodiment of the capping assembly including a substantially airtight seal used during shipping of the ink jet printer.

An example of the application of a heat sealed membrane 74 is illustrated in an alternate embodiment of the capping assembly 38, a portion of which is illustrated in FIG. 4. In this alternate embodiment of the capping assembly 38, an alternative capping gasket member 76 is shown compressed, resulting from pressure applied by the sealing of the heat sealed membrane to the raised portion 72 of the cap housing 52.

Figure 5:
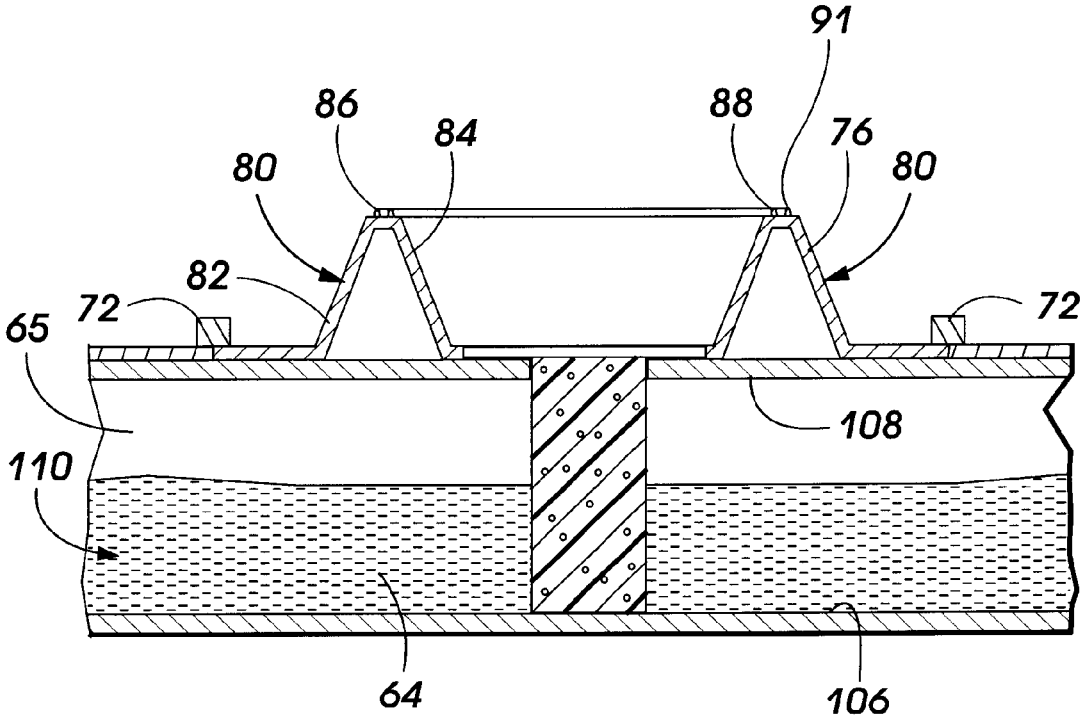
FIG. 5 is a schematic sectional view of the capping assembly of FIG. 4.
Figure 6:
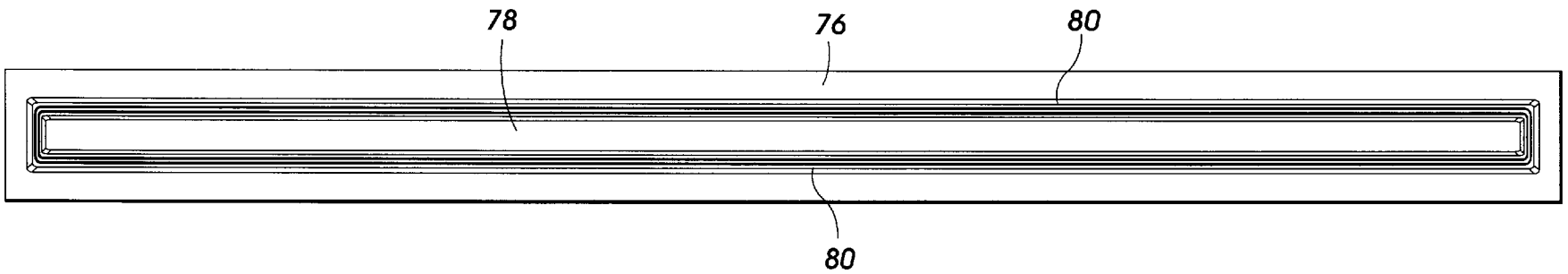
FIG. 6 is a schematic plan view of a second embodiment of the gasket member of the capping assembly of the present invention.

FIG. 5 illustrates a view of the gasket member 76 in an uncompressed state and FIG. 6 illustrates a plan view of the same gasket member. The capping gasket member 76 of FIGS. 4, 5 and 6 includes an aperture 78 which would be positioned over the previously described venting apertures 59. The capping gasket member 76 also includes a wall portion 80 which completely surrounds the aperture 78 and which is comprised of a first side wall 82 and a second side wall 84 which meet at a contacting ridge 86 having a first rib 88 and a second rib 91. As can be seen in FIG. 4, when the capping gasket member 76 is under compression by either the heat seal membrane 74 or by capping of the printheads, the top ridge 86 is compressed into the space previously formed by the first side wall 82 and the second side wall 84. While the capping gasket member 76 provides for a substantially airtight seal when in contact with the printheads, the capping gasket member 56, of FIGS. 1, 2 and 3, is preferred since the capping gasket member 76 requires more force to adequately compress it than is required for that 56.

The sealing membrane 74 is preferably made of a material which minimizes the moisture vapor transfer rate from the cap housing. Metalized materials with polyethylene interior surfaces are suitable for this application. The membrane is preferably constructed such that the interior layer in contact with the gasket either fails cohesively during the removal operation or the adhesive bond between this layer and the cap housing is the weakest bond. This assures that the seal is removed cleanly when the capping assembly is put into operation. Such a metalized material having a polyethylene interior heat sealed to protect the contents disposed therein is understood and known by those skilled in the art. The membrane can also include a convenient tab for customer access and removal.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A customer replaceable, multiple function printhead capping assembly for use in an ink printer, the capping assembly comprising:

(a) a housing having walls including side walls, a bottom wall and a top wall, said walls defining a fluid chamber for containing fluid consisting of cleaning liquid and vapors from the cleaning liquid;

(b) at least one venting first aperture formed through said top wall of said housing into said chamber for releasing fluid from said fluid chamber;

(c) a substantially airtight sealing member surrounding said at least one venting first aperture for sealing and humidifying an ink jet printhead in a capping position on the capping assembly;

(d) a liquid flow second aperture formed through said bottom wall of said housing and communicating with said fluid chamber for supplying cleaning fluid from said fluid chamber to a printhead maintenance assembly, thereby enabling the printhead maintenance assembly and the capping assembly to have a common cleaning fluid; and (e) a quick snap-in, snap-out, valve connector mounted over said liquid flow second aperture for connecting said fluid chamber of said capping assembly to a liquid supply line of the printhead maintenance assembly for supplying cleaning liquid from said fluid chamber of said capping assembly to the printhead maintenance assembly, and to enable easy economical customer removal and replacement of said capping assembly within the ink jet printer, thus assuring continued quality printing.

2. An ink jet printer comprising:

(a) a movable printhead assembly having printheads including ink and nozzles for printing onto a recording medium;

(b) a maintenance assembly having liquid application members for cleaning and priming said printheads;

(c) a customer replaceable, multiple function capping assembly having:

(i) walls defining a fluid chamber, said fluid chamber containing a fluid consisting of cleaning liquid and vapors from said cleaning liquid;

(ii) a venting aperture formed through a wall of said housing for releasing fluid;

(iii) a liquid flow aperture formed through a bottom wall of said walls of said housing for cleaning liquid flow from said chamber for supplying cleaning fluid from said fluid chamber to a printhead maintenance assembly, thereby enabling the printhead maintenance assembly and the capping assembly to have a common cleaning fluid; and (iv) a quick snap-in, snap-out, valve connector mounted over said liquid flow second aperture for connecting said fluid chamber of said capping assembly to a liquid supply line of the printhead maintenance assembly for supplying cleaning liquid from said fluid chamber of said capping assembly to the printhead maintenance assembly, and to enable easy economical customer removal and replacement of said capping assembly within the ink jet printer, thus assuring continued quality printing of the ink jet printer.

3. The ink jet printer of claim 2, wherein said capping assembly includes gasket members mounted around said venting aperture for providing an airtight seal against a printhead being capped and humidified.

4. The ink jet printer of claim 3, wherein said gasket member comprises a thermoplastic elastomeric material.

5. The ink jet printer of claim 3, wherein said substantially airtight seal comprises a heat sealed membrane covering each of said plurality of venting apertures.

6. The ink jet printer of claim 2, including a liquid conduit member connected to said capping assembly and to said maintenance assembly supplying cleaning liquid from said fluid chamber to said maintenance assembly.

7. The ink jet printer of claim 2, including a wicking member disposed in said venting aperture for contacting the cleaning liquid within said chamber, and for wicking cleaning liquid through said venting aperture.

8. The ink jet printer of claim 7, wherein said wicking member comprises sintered polypropylene.

9. The ink jet printer of claim 2, wherein said capping assembly includes a plurality of said venting apertures.

10. The ink jet printer of claim 2, wherein during shipping, a substantially air impervious seal covering said venting aperture, is included for preventing said cleaning liquid within said fluid chamber from venting through said venting aperture.

11. A customer replaceable, multiple function printhead capping assembly for use in an ink jet printer, the capping assembly comprising:

(a) a housing having walls defining a fluid chamber;

(b) at least one venting first aperture formed through a first one of said walls into said fluid chamber for releasing fluid from said fluid chamber;

(c) a liquid flow second aperture formed through a second one of said walls and communicating with said fluid chamber for supplying cleaning fluid from said fluid chamber to a printhead maintenance assembly, thereby enabling said printhead maintenance assembly and said capping assembly to have a common cleaning fluid; and (d) a quick snap-in, snap-out, valve connector mounted over said liquid flow second aperture for connecting said fluid chamber of said capping assembly to a liquid supply line of the printhead maintenance assembly for supplying cleaning liquid from said fluid chamber of said capping assembly to the printhead maintenance assembly, and for enabling easy economical customer removal and replacement of said capping assembly within the ink jet printer, thus assuring continued quality printing.

* * * * *